US007331127B2

(12) United States Patent
Byrnes et al.

(10) Patent No.: US 7,331,127 B2
(45) Date of Patent: Feb. 19, 2008

(54) REDUCED SKIN ABRASION SHOE

(75) Inventors: Tracy Byrnes, Erie, CO (US); Sean Sullivan, Boulder, CO (US)

(73) Assignee: DashAmerica, Inc., Broomfield, CO (US)

( * ) Notice: Subject to any disclaimer, the term of this patent is extended or adjusted under 35 U.S.C. 154(b) by 599 days.

(21) Appl. No.: 10/660,411

(22) Filed: Sep. 10, 2003
(Under 37 CFR 1.47)

(65) Prior Publication Data

US 2006/0162187 A1 Jul. 27, 2006

(51) Int. Cl.
*A43B 23/07* (2006.01)

(52) U.S. Cl. ..... 36/55; 36/54; 36/72 B; 36/57

(58) Field of Classification Search ..... 36/54, 36/55, 72 B, 47, 57, 45
See application file for complete search history.

(56) References Cited

U.S. PATENT DOCUMENTS

| | | | | |
|---|---|---|---|---|
| 968,020 | A | 8/1910 | Yandoll | |
| 1,283,456 | A | 11/1918 | Basler | |
| 2,199,338 | A | 4/1940 | Golden | |
| 2,235,694 | A | 3/1941 | Wolfhard et al. | |
| 2,306,306 | A * | 12/1942 | Ferrettie | 36/4 |
| 2,340,578 | A | 2/1944 | Cairns | |
| 2,619,743 | A * | 12/1952 | Harris | 36/8.3 |
| 3,117,331 | A | 1/1964 | Arnau | |
| 3,344,537 | A * | 10/1967 | Diamant | 36/91 |
| 4,120,101 | A * | 10/1978 | Drew | 36/4 |
| 4,296,499 | A | 10/1981 | Patterson et al. | |
| 4,366,634 | A | 1/1983 | Giese et al. | |
| 4,785,558 | A | 11/1988 | Shiomura | |
| 5,086,576 | A | 2/1992 | Lamson | |
| 5,105,565 | A | 4/1992 | Barret | |
| 5,154,682 | A | 10/1992 | Kellerman | |
| 5,167,084 | A | 12/1992 | Flammier | |
| 5,461,884 | A | 10/1995 | Depoe et al. | |
| 5,566,475 | A | 10/1996 | Donnadieu | |
| 5,799,416 | A | 9/1998 | Prober | |
| 5,933,984 | A | 8/1999 | Carlson et al. | |
| 6,029,376 | A | 2/2000 | Cass | |
| 6,067,987 | A | 5/2000 | Scheinberg | |
| 6,115,948 | A | 9/2000 | Mitchell | |
| 6,557,274 | B2 | 5/2003 | Litchfield et al. | |
| 2006/0143949 | A1 | 7/2006 | Wiper | |

FOREIGN PATENT DOCUMENTS

| | | |
|---|---|---|
| GB | 2342275 | 4/2000 |

* cited by examiner

*Primary Examiner*—Ted Kavanaugh
(74) *Attorney, Agent, or Firm*—Dorsey & Whitney LLP

(57) ABSTRACT

The present invention relates to a reduced abrasion shoe. The reduced abrasion shoe comprises strategically removing seams from the interior cavity of the shoe. In particular, the tongue traversing the throat is attached to the exterior surface of the upper about the toe box. A full liner between the upper and the interior cavity is coupled to the upper about the shoe mid-point. Finally, exterior surface patches are coupled to the exterior surface using a fusion bond instead of a stitch to remove the corresponding interior seam.

11 Claims, 3 Drawing Sheets

REDUCED SKIN ABRASION SHOE

FIELD OF THE INVENTION

The present invention relates to shoes and, more particularly, to a sport shoe with reduced foot abrasion.

BACKGROUND OF THE INVENTION

Shoes have been specialized and improved for years. Currently, shoe manufacturers and designers provide specialized shoes for many activities, such as, for example, running shoes, tennis shoes, cycling shoes, walking shoes, cross-trainers, and the like. These shoes can be designed to respond to particular pressures and hot spots for the assumed usage.

The design of the shoe, however, has only come so far. Many shoes also include inserts, liners, padding, environmental protection, and the like. Many of these designs reduce moisture and heat generated by the foot within the shoe. Reducing the moisture and heat provides some reduction in foot or skin abrasion against the shoe, which in turn reduces blistering and the like. For example, liners are typically made out of a breathable material. Inserts may include moisture absorbing or wicking properties.

Despite the above and other improvements to shoe designs, many users experience blistering or other irritation on their feet when performing more strenuous activities than, for example, walking. In particular, internal seams where a shoe tongue and external patches are connected to the shoe provide irritants. Thus, it would be desirous to develop an improved shoe to reduce skin abrasion.

SUMMARY OF THE INVENTION

To attain the advantages and in accordance with the present invention, a reduced abrasion shoe is provided. The shoe comprises a sole and an upper forming an interior foot portion and an exterior portion. The upper of the shoe includes a toe box, a throat, and a heel. A tongue is coupled to the upper such that the seam resides on the exterior surface of the toe box. The tongue also includes the transition being where the tongue transitions from the exterior surface to the interior cavity.

Another embodiment of the present invention provides a reduced abrasion shoe having a sole and an upper coupled to the sole. The upper and the sole form an exterior surface and an interior cavity. The upper includes a toe box, a throat, and a heel along with a tongue traversing the throat area. A liner between the upper and the interior cavity is coupled to the upper about the mid-point of the shoe.

Still another embodiment of the present invention provides a reduced abrasion shoe having a sole and an upper coupled to the sole. The upper and the sole form an exterior surface and an interior cavity. The upper includes along with a tongue that that traverses the throat. At least one patch is coupled to the exterior surface using a weld.

The foregoing and other features, utilities and advantages of the invention will be apparent from the following more particular description of a preferred embodiment of the invention as illustrated in the accompanying drawings.

BRIEF DESCRIPTION OF THE DRAWING

The accompanying drawings, which are incorporated in and constitute a part of this specification, illustrate embodiments of the present invention, and together with the description, serve to explain the principles thereof. Like items in the drawings are referred to using the same numerical reference.

DETAILED DESCRIPTION

Figure 1:
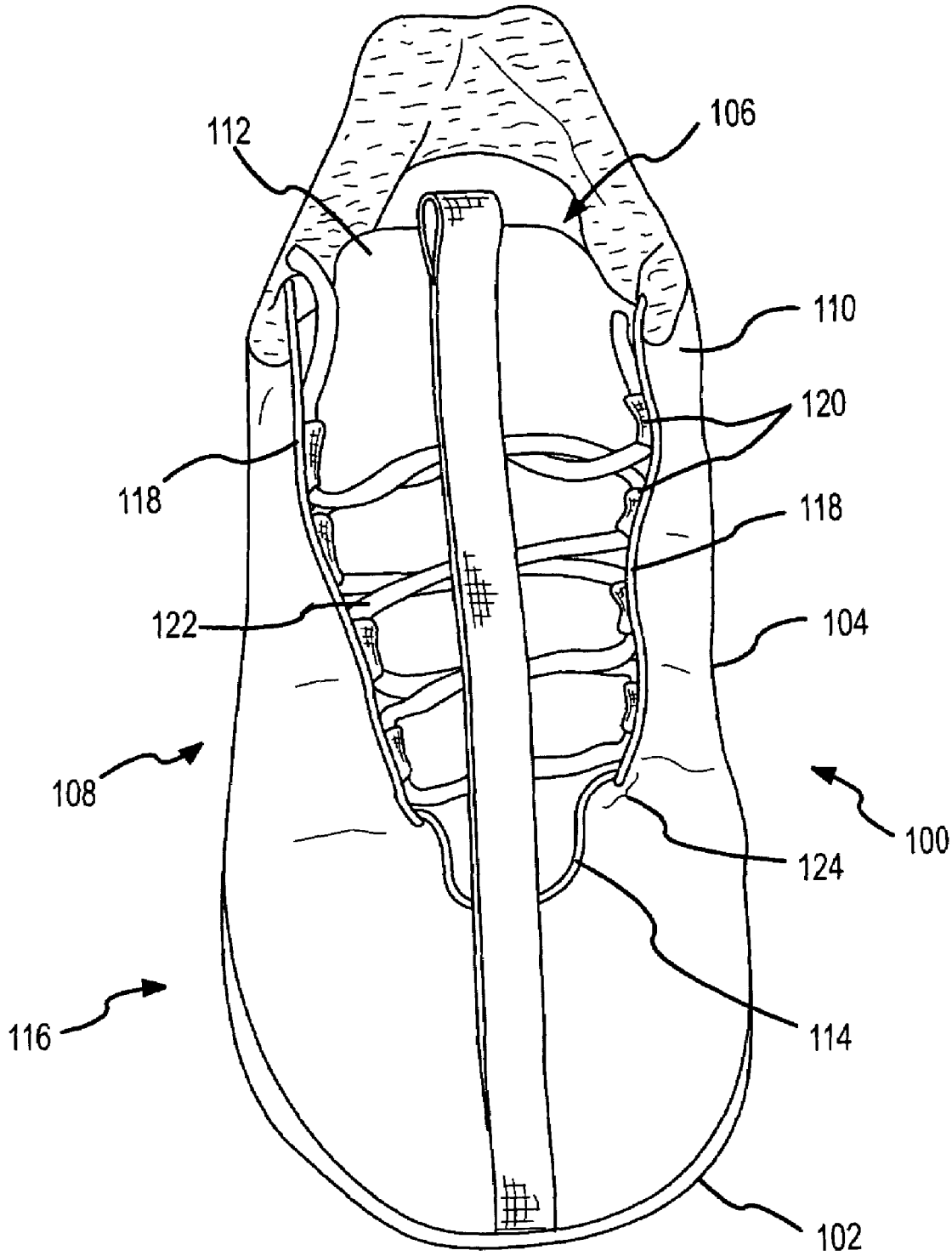
FIG. 1 is a top side elevation of a shoe constructed in accordance with an embodiment of the present invention.

The present invention will be described with reference to FIGS. 1-3. While the present invention is shown and described with regard to a running shoe, one of ordinary skill in the art would recognize on reading the disclosure that alternative shoes styles could use the invention described herein, and the use of a running shoe is exemplary and non-limiting. Other styles of shoes that would benefit from the present invention include, without limitation, cycling shoes, sport cleats, basketball shoes, tennis shoes, and walking shoes FIG. 1 shows a top elevation view of a running shoe 100. Running shoe 100 includes a sole 102 and an upper 104. Sole 102 and upper 104 form an internal cavity 106 to accept a user's foot and an external portion 108. Upper 104 has a throat 110. A tongue 112 traverses throat 110 and is attached to upper 104 by a seam 114 at a toe box portion 116 of shoe 100. Seam 114 could be any conventional seam or connection, such as, for example, a stitch, a heat fusion seam, or the like.

Upper 104, typically, has two symmetrical boarders 118 outlining throat 110. Loops 120 are conventionally connected to boarders 118. One or more laces 122 traverse throat 110 by threading through loops 120 in a zigzag pattern. Loops 110 and laces 122 could be replaced by other conventional tightening devices, such as strips of hook and loop material, such as, VELCRO®.

As can be seen in FIG. 1, seam 114 resides on external portion 108 of shoe 100. Thus, upper 104 is between seam 114 and the foot of a user. Because seam 114 is separated from the foot, skin abrasion or friction is reduced. The reduction in abrasion and/or friction reduces irritation. Seam 114 ends at a transition portion 124. As seen, tongue 112 is attached on external portion 108 about toe box 116, but tongue 112 resides in the internal cavity 106 below symmetrical boarders 118, which allows laces 122 to reside in external portion 108. Thus, transition portion 124 guides tongue 112 from being in external portion 108 to internal portion 106.

Figure 2:
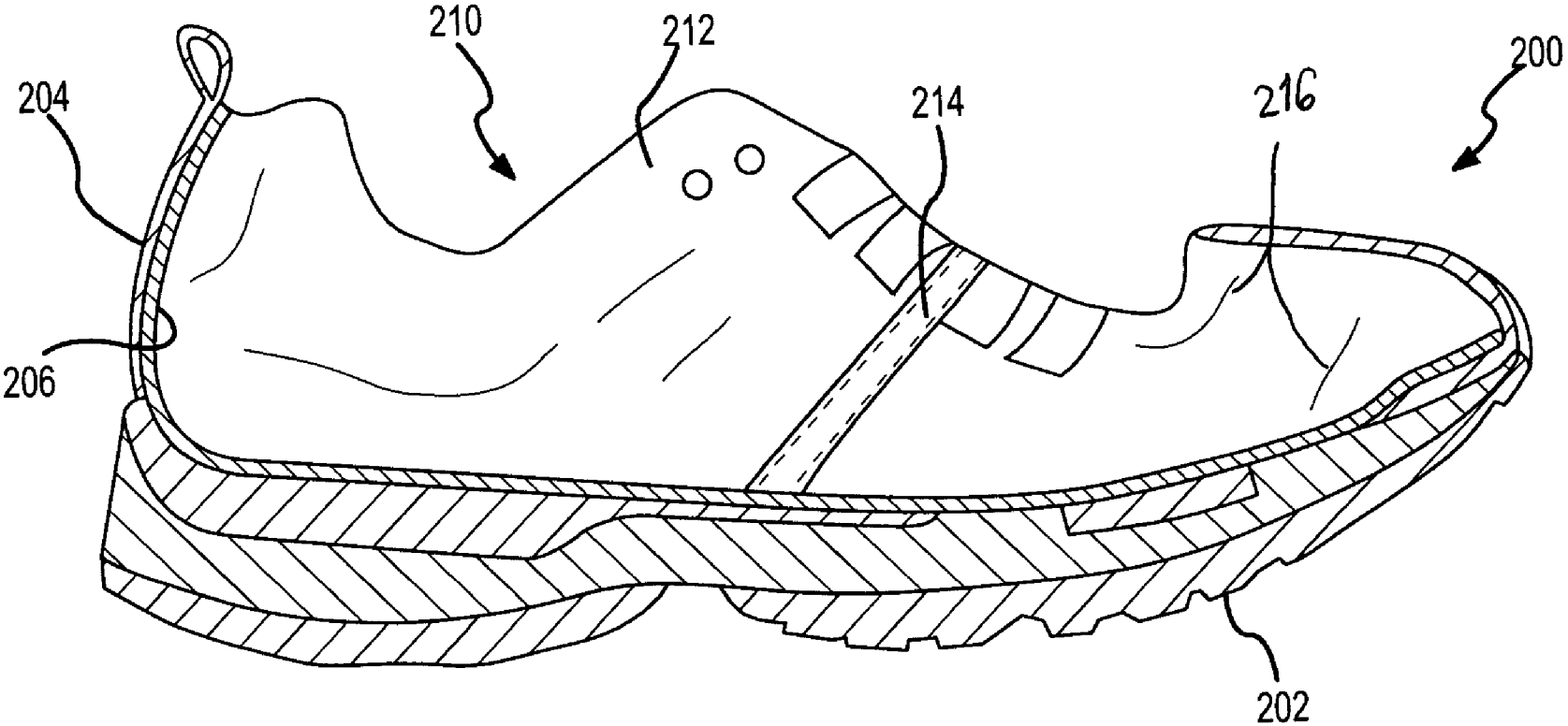
FIG. 2 is a cross-section view of a shoe constructed in accordance with another embodiment of the present invention.

Referring now to FIG. 2, another shoe 200 consistent with the present invention is shown. Shoe 200 comprises a sole 202 and an upper 204. Upper 204 has an interior side 206 and an exterior side 208 (not specifically labeled in the figure). Sole 202 and interior side 206 define a cavity 210 to accept a user's foot. A liner 212 resides between interior side 206 and the user's foot. Liner 212 is attached to interior side 206 about the instep, midsole, or mid-point of the shoe by a seam 214. In this case, seam 214 is a conventional stitch, but could be a heat welded seam or the like. As can be seen, liner 212 lines the entire cavity 210. Lining the entire cavity with the protective layer reduces skin abrasion. Also, providing seam 214 about the foot arch or instep of the shoe additionally reduces friction, in part because of the lower pressures those portions of the foot are subject to and, in part, because less of the foot is exposed to the seam. Liner 212 could be any number of low friction materials, such as, for example, a mesh liner. Further, liner 212 could be loaded with moisture wicking or absorbing materials 216 to further reduce skin abrasion.

Figure 3:
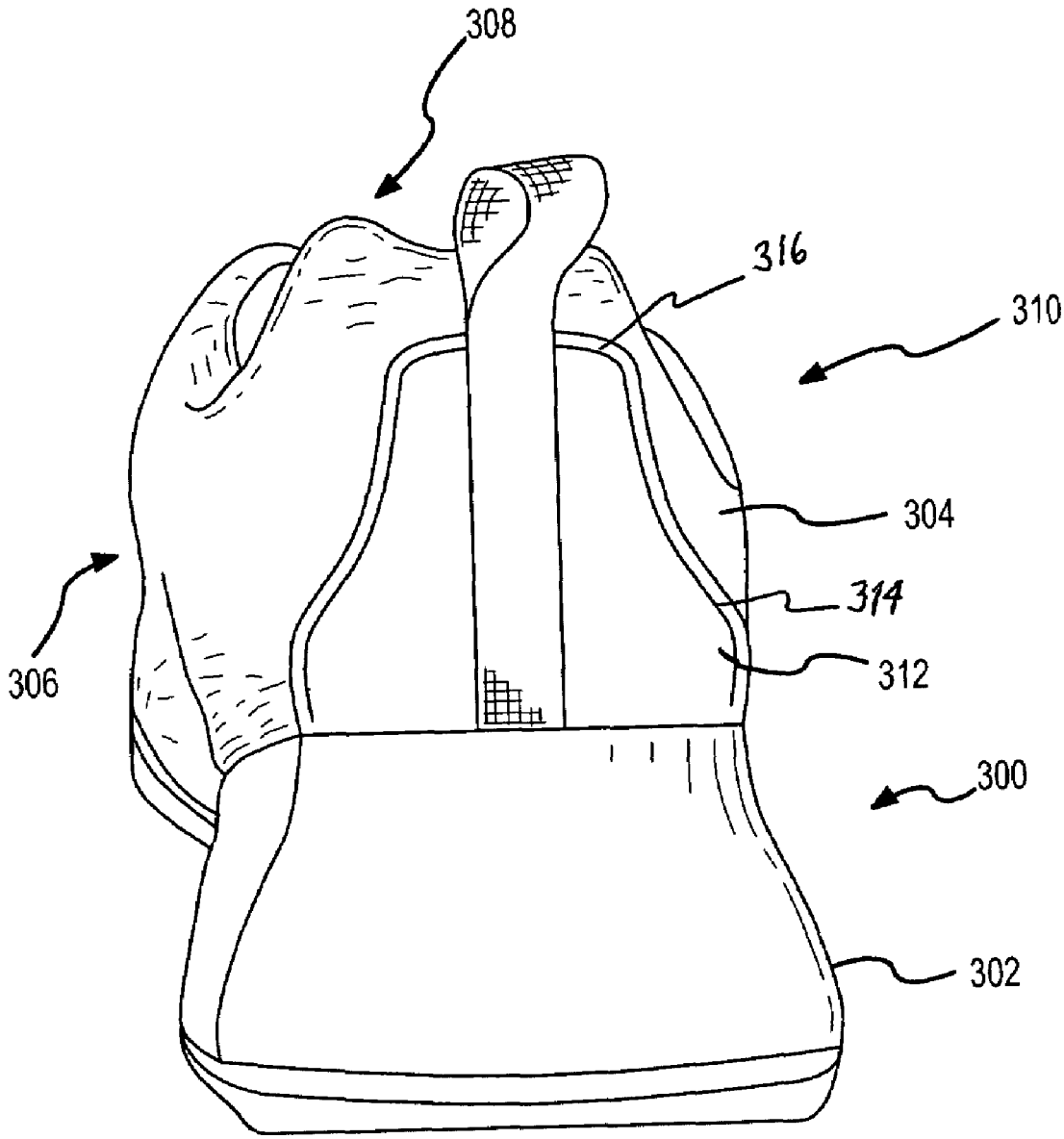
FIG. 3 is rear elevation view of a shoe constructed in accordance with another embodiment of the present invention.

FIG. 3 shows a rear elevation view of a shoe 300. Shoe 300 includes a sole 302 and an upper 304. Upper 304 includes a toe box 306, a throat 308, and a heel 310. A patch 312 is coupled to shoe 300 about heel 310. Patch 312 provides upper 304 protection from the environment, such as, for example, scuffing the shoe. Patch 312 could be located in one or more places on the shoe. For example, many shoes have patches on heel 310 and toe box 306. Patch 312 could comprise leather, synthetic leather, rubber, or other composites as desired.

As mentioned in the background of the invention, conventional methods to couple patch 312 to upper 304 use a stitch. The stitch, however, causes a corresponding seam on in an interior portion 314 of shoe 300. In order to remove the seam on interior portion 314 of shoe 300, patch 312 is welded to upper 304 along weld line 316. By welding patch 312 to upper 304, an irritant, namely the interior seam, is removed. Removing the irritant reduces skin abrasion and friction.

While the invention has been particularly shown and described with reference to an embodiment thereof, it will be understood by those skilled in the art that various other changes in the form and details may be made without departing from the spirit and scope of the invention.

We claim:

1. A reduced abrasion shoe, comprising:

a sole;

an upper coupled to the sole;

the upper and the sole forming an exterior surface and an interior cavity;

the upper comprising a toe box, a throat, and a heel;

a tongue coupled to the upper such that the seam resides on the exterior surface of the toe box;

the tongue comprising a portion on the exterior surface and a portion in the interior cavity, and a transition, the transition being where the tongue transitions from the exterior surface to the interior cavity;

a liner between the upper and the interior cavity substantially separating the upper from the interior cavity; and the liner coupled to the upper about a mid-point of the shoe wherein the coupling of the liner and upper will only cause skin abrasion in a foot arch area of the shoe.

2. The shoe according to claim 1, wherein the liner is coupled to the upper using a stitch.

3. The shoe according to claim 1, further comprising a patch coupled to the exterior surface using a weld without causing a seam in the interior cavity.

4. The shoe according to claim 3, wherein the shoe comprises a shoe from the group consisting of a cycling shoe, a running shoe, a tennis shoe, a sneaker, a soccer shoe, a bowling shoe, a football shoe, a cleat, a basketball shoe, and a golf shoe.

5. A reduced abrasion shoe, comprising:

a sole;

an upper coupled to the sole;

the upper and the sole forming an exterior surface and an interior cavity;

the upper comprising a toe box, a throat, and a heel;

a tongue coupled to the upper; and a liner between the upper and the interior cavity substantially separating the upper from the interior cavity, the liner coupled to the upper about a mid-point of the shoe wherein the coupling of the liner and upper will only cause skin abrasion in a foot arch area of the shoe.

6. The shoe according to claim 5, wherein the liner comprises a mesh material.

7. The shoe according to claim 5, wherein the liner comprises a low friction material.

8. The shoe according to claim 7, wherein the tongue is coupled to the toe box such that the seam resides on the exterior surface.

9. The shoe according to claim 5, further comprising a patch coupled to the exterior surface of the upper.

10. The shoe according to claim 9, wherein the patch is coupled to the exterior surface using a weld without causing a seam in the interior cavity.

11. A reduced abrasion shoe, comprising:

a sole;

an upper coupled to the sole;

the upper and the sole forming an exterior surface and an interior cavity;

the upper comprising a toe box, a throat, and a heel;

a tongue coupled to the upper such that the seam resides on the exterior surface of the toe box;

the tongue comprising a portion on the exterior surface and a portion in the interior cavity, and a transition, the transition being where the tongue transitions from the exterior surface to the interior cavity;

a liner between the upper and the interior cavity substantially separating the upper from the interior cavity, the liner coupled to the upper about a mid-point of the shoe wherein the coupling of the liner and upper will only cause skin abrasion in a foot arch area of the shoe; and at least one patch coupled to the exterior surface of the shoe, wherein the at least one patch is coupled to the exterior surface using a fusion bond.

* * * * *